US007012179B2

(12) United States Patent
Shimano

(10) Patent No.: US 7,012,179 B2
(45) Date of Patent: Mar. 14, 2006

(54) FALL BOARD STOPPER FOR KEYBOARD INSTRUMENT

(75) Inventor: Atsushi Shimano, Hamamatsu (JP)

(73) Assignee: Yamaha Corporation, Shizuoka-Ken (JP)

( * ) Notice: Subject to any disclaimer, the term of this patent is extended or adjusted under 35 U.S.C. 154(b) by 135 days.

(21) Appl. No.: 10/678,087

(22) Filed: Oct. 6, 2003

(65) Prior Publication Data

US 2004/0069113 A1 Apr. 15, 2004

(30) Foreign Application Priority Data

Oct. 9, 2002 (JP) ..... 2002-295773

(51) Int. Cl.
*G10C 13/02* (2006.01)

(52) U.S. Cl. ..... 84/179; 84/178

(58) Field of Classification Search ..... 84/178, 84/179, 175–176, 180–183
See application file for complete search history.

(56) References Cited

U.S. PATENT DOCUMENTS

| | | | | |
|---|---|---|---|---|
| 4,817,487 | A * | 4/1989 | Yamashita | 84/179 |
| 6,076,421 | A * | 6/2000 | Ikegami | 74/473.28 |
| 2002/0092400 | A1 * | 7/2002 | Ichikawa | 84/180 |

FOREIGN PATENT DOCUMENTS

| | | |
|---|---|---|
| EP | 0 289 954 | 11/1988 |
| JP | 5-48238 | 12/1993 |
| JP | 8-234726 | 9/1996 |
| JP | 9-62252 | 3/1997 |
| JP | 2000-250529 | 9/2000 |
| JP | 2002-297122 | 10/2002 |

OTHER PUBLICATIONS

Copy of European Search Report dated Dec. 15, 2003.

* cited by examiner

*Primary Examiner*—Kimberly Lockett
(74) *Attorney, Agent, or Firm*—Dickstein, Shapiro, Morin & Oshinsky, LLP.

(57) ABSTRACT

A fall board stopper is provided for a keyboard instrument such as a grand piano, which is equipped with a fall board that is opened or closed on keys arranged on a keybed. It is basically constituted by a first stopper member and a second stopper member, which are normally separated from each other and which are respectively attached to a prescribed part (e.g., an interior wall of a side board) of the keyboard instrument and a backend portion of the fall board at a prescribed position. The first stopper member has an engagement portion that is engaged with the second stopper member when the fall board is opened, so that the fall board can be reliably stopped in position when opened upon a mechanical engagement established between the first and second stopper members.

6 Claims, 6 Drawing Sheets

FALL BOARD STOPPER FOR KEYBOARD INSTRUMENT

BACKGROUND OF THE INVENTION

1. Field of the Invention

This invention relates to fall board stoppers for keyboard instruments such as grand pianos.

2. Description of the Related Art

Keyboard instruments (e.g., grand pianos in particular) have fall boards whose opening angles are approximately set to 90°, and when fall boards are closed, they are held roughly in parallel with keybeds for arranging keys, while when maximally opened, fall boards are held roughly perpendicular to keybeds.

An example of a conventionally-known grand piano equipped with a fall board will be described with reference to FIGS. 7A and 7B, wherein FIG. 7A is a cross sectional view showing essential parts interlocked with the fall board of the grand piano, and FIG. 7B is a side view specifically showing the fall board and its related parts. Herein, reference numeral 1 designates a fall board, 2 designates a keybed, 3 designates a key slip, 4 designates an upper beam, 5 designates a lock slip, 6 designates a top board, 7 designates a pin block, and 8 designates a side board, all of which are assembled together to form a casing 10, which also incorporates a keyboard 11, actions, strings, and the like.

The backend portion of the fall board 1 is pivotally supported by a pair of open/close devices 12 at right and left ends thereof, so that the fall board 1 can be freely rotated about a prescribed axis thereof, or it can be vertically opened or closed over the keybed 2. A bent portion 1*a* is formed at the tip end of the fall board 1, which is therefore supported by the upper surface of the key slip 3 when closed (see solid-line illustration in FIG. 7A), whereby the fall board 1 is roughly maintained in parallel with the keybed 2. When opened, the fall board 1 is stood against and in proximity to the exterior surface of the upper beam 4 (see dashed-line illustration in FIG. 7A), so that the fall board 1 is maintained roughly perpendicular to the keybed 2 and is slightly slanted backwards.

As shown in FIG. 7B, each of the open/close devices 12 that are attached to both ends of the backend portion of the fall board 1 is constituted by a shaft 15 and a metal member 16 having a roughly U-shaped bearing hollow 17, wherein the shaft 15 is loosely engaged with the hollow 17 and is supported by the metal member 16 in a free-rotation manner. That is, the backend portion of the fall board is equipped with a pair of shafts 15 that are slightly projected from both ends thereof and a pair of metal members 16 that are fixed to interior surfaces of the side boards 8, which are arranged on both sides of the keybed 2. Incidentally, the shafts 15 form a rotation center 'O' allowing the fall board 1 to be rotated thereabout.

A weight (or weights) 18 is attached to a prescribed position of the backend surface of the fall board 1 and is normally located above the rotation center O when the fall board 1 is closed (see FIG. 7A). Due to the provision of the weight 18, it is possible to improve stability in operating the fall board 1, which is therefore prevented from being normally (or unexpectedly) closed due to vibration and the like. When the fall board 1 is opened, the weight 18 attached to the backend surface of the fall board 1 is moved downwards and is located backwardly from the rotation center O; that is, the weight 18 imparts a prescribed rotation behavior to the fall board 1 in a backward direction, which in turn prevents the fall board 1 from easily falling down in a forward direction (toward a player's side).

As the material for the weight 18, it is possible to use lead that may be inexpensive and that has a high specific gravity among metal materials used in industrial fields. However, the lead is a heavy metal that is harmful to the human body and the natural environment; therefore, it may be preferable not to use it in view of protection of the environment. For this reason, there are recently provided other types of fall board structures that prevent fall boards from unexpectedly falling down without the use of lead weights, examples of which are disclosed in Japanese Patent Application Publication No. Hei 9-62252 and Japanese (Examined) Utility Model Publication No. Hei 5-48238.

In a keyboard instrument disclosed in Japanese Patent Application Publication No. Hei 9-62252, a pair of magnets are respectively attached to the backend surface of a fall board and a corresponding portion of a keyboard, so that when the fall board is opened, the magnet attached to the backend surface of the fall board is moved close to the magnet attached to the keyboard, whereby due to magnetic force exerted between the magnets, the fall board is maintained in an opened state and is prevented from unexpectedly falling down due to vibration and the like.

In a keyboard instrument disclosed in Japanese Utility Model Publication No. Hei 5-48238, a rotary damper utilizing viscous resistance of fluid is used as an open/close device for a fall board. When the fall board is opened, the rotary damper is reduced in viscous resistance of fluid; therefore, it allows the fall board to be manually opened with force similar to that of a normal fall board not equipped with the rotary damper. When the fall board is closed, the viscous resistance of fluid of the rotary damper is gradually increased as the tip end of the fall board descends down to the keybed, so that the fall board is controlled in downward movement. This allows the user of the keyboard instrument to slowly move down and close the fall board.

Both of the conventionally-known fall board structures adapted to the aforementioned keyboard instruments may not provide a sufficient degree of stability in operation when fall boards are opened. That is, the fall board structure using the magnet as disclosed in Japanese Patent Application Publication No. Hei 9-62252 utilizes magnetic absorption in maintaining the fall board in position, which however cannot completely fix the fall board in an opened state; therefore, when an external force is accidentally applied to the fall board, the fall board may be rotatably moved and closed with ease.

The other fall board structure using the rotary damper as disclosed in Japanese Utility Model Publication No. Hei 5-48238 may be advantageous in that it can reliably prevents the fall board from rapidly falling down, wherein the controlling force applied to the fall board depends upon a load resistance that occurs as the fall board is rotated. Therefore, when an external force is applied to the fall board, which is opened, in a closing direction, it may be difficult to reliably stop the fall board from falling down.

SUMMARY OF THE INVENTION

It is an object of the invention to provide a fall board stopper having a simple structure for use in a keyboard instrument, in which a fall board is improved in stability when opened and is reliably prevented from being unexpectedly closed due to vibration and the like.

A fall board stopper is provided for a keyboard instrument such as a grand piano, which is equipped with a fall board that is opened or closed on keys arranged on a keybed. It is basically constituted by a first stopper member and a second stopper member, which are normally separated from each other and which are respectively attached to a prescribed part (e.g., an interior wall of a side board) of the keyboard instrument and a backend portion of the fall board at a prescribed position. The first stopper member has an engagement portion that is engaged with the second stopper member when the fall board is opened, so that the fall board can be reliably stopped in position when opened upon a mechanical engagement established between the first and second stopper members.

That is, a plate spring corresponding to the second stopper member is elastically deformed and slides along a slope of the first stopper member as the fall board is opened so that the tip end portion thereof is finally engaged with a hollow corresponding to the engagement portion of the first stopper member. Alternatively, it is possible to use a ball plunger as the second stopper member, wherein a ball partially projected outside of the ball plunger is engaged with a recess corresponding to the engagement portion of the first stopper member.

Thus, it is possible to noticeably improve the stability and security of the fall board of the keyboard instrument when opened.

BRIEF DESCRIPTION OF THE DRAWINGS

These and other objects, aspects, and embodiments of the present invention will be described in more detail with reference to the following drawings, in which.

DESCRIPTION OF THE PREFERRED EMBODIMENTS

This invention will be described in further detail by way of examples with reference to the accompanying drawings.

Figure 1:
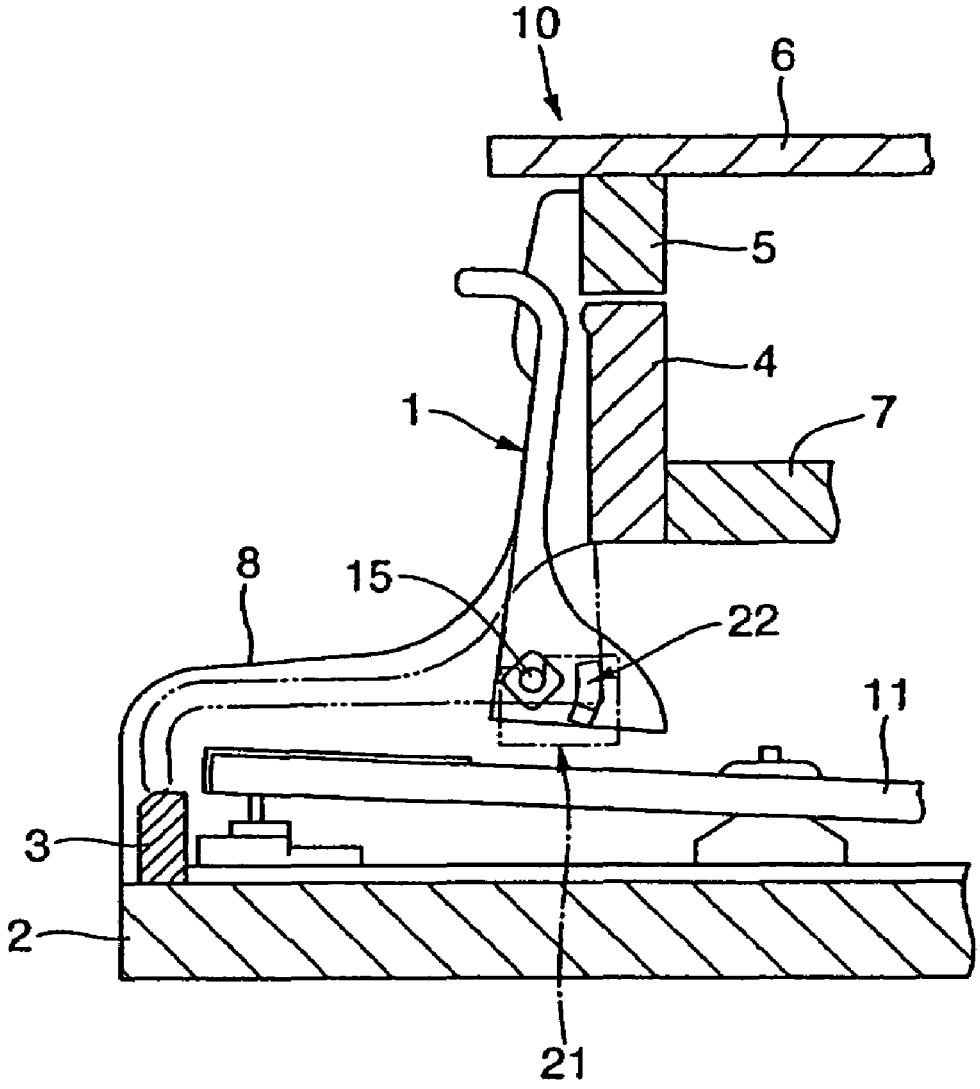
FIG. 1 is a cross sectional view showing essential parts of a keyboard structure of a grand piano having a fall board equipped with a fall board stopper in accordance with an embodiment of the invention.
Figure 2:
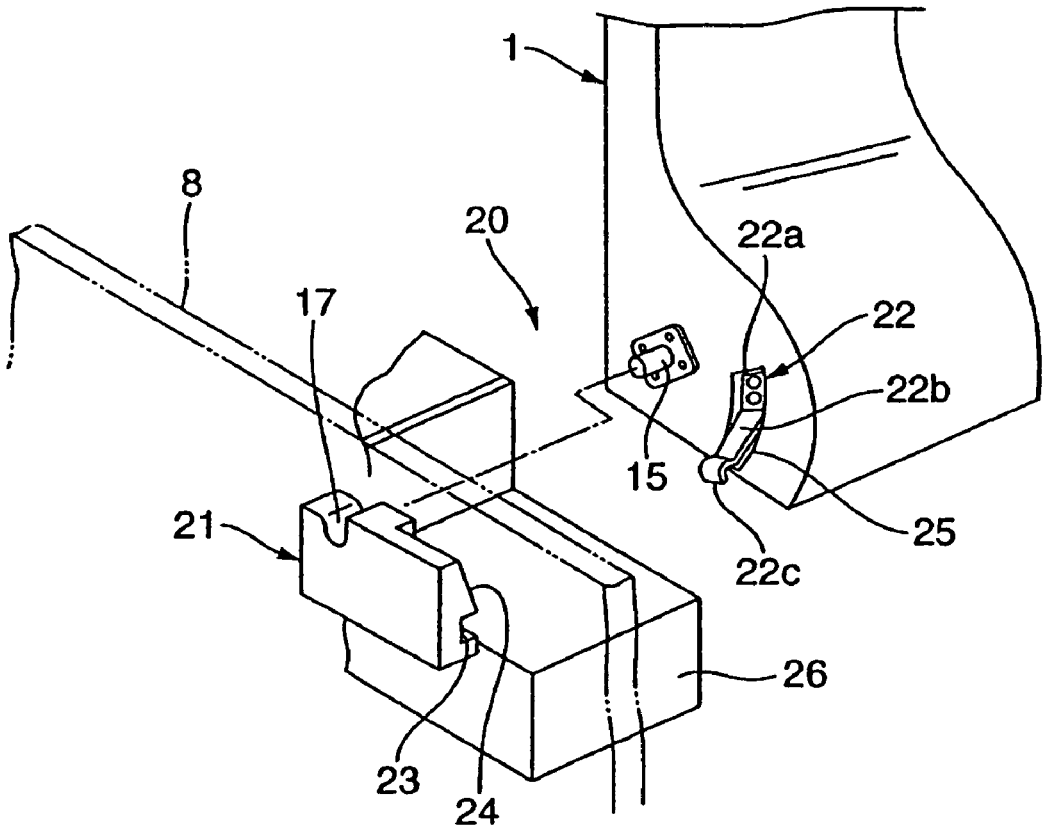
FIG. 2 is a perspective view showing essential parts of the fall board stopper and its related parts in the grand piano.
Figure 3:
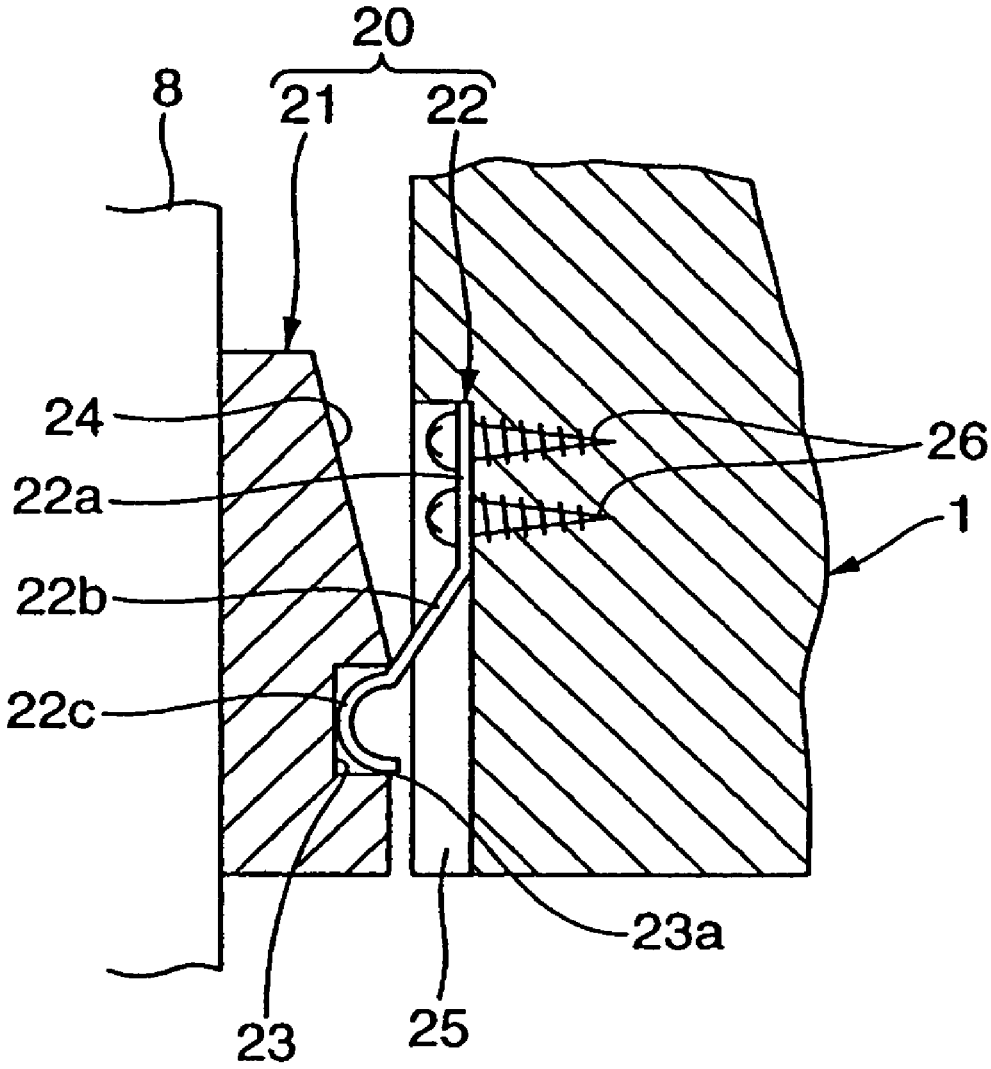
FIG. 3 is a cross sectional view showing a part of the fall board that is opened and then stopped at a rest position by the fall board stopper.
Figure 7A:
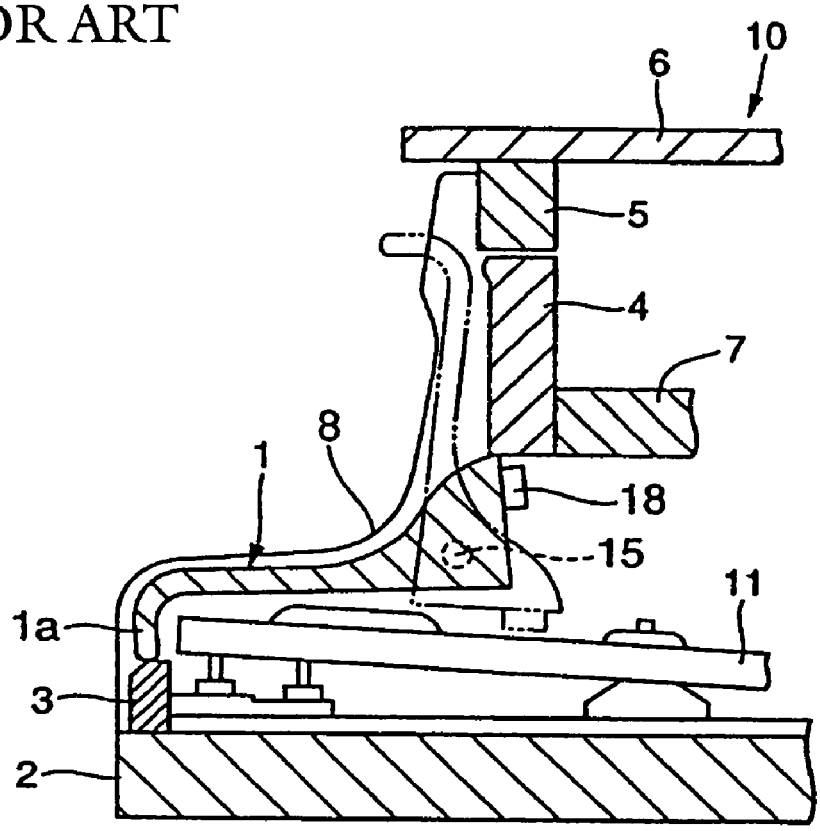
FIG. 7A PRIOR ART
FIG. 7A is a cross sectional view showing a fall board and its related parts used in a keyboard of a grand piano.
Figure 7B:
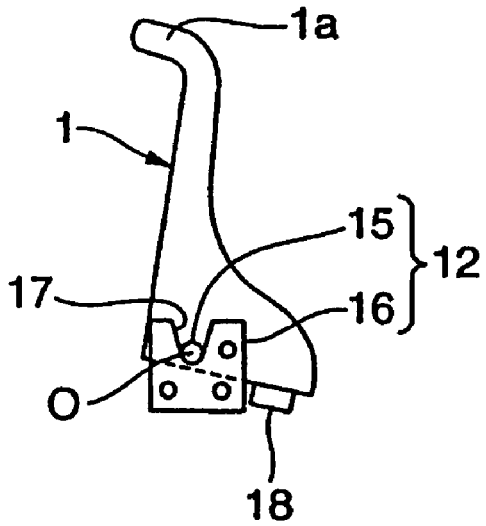
FIG. 7B PRIOR ART
FIG. 7B is a side view showing an open/close device for use in the fall board shown in FIG. 7A.

FIG. 1 is a cross sectional view showing essential parts of a keyboard structure of a grand piano equipped with a fall board stopper in accordance with an embodiment of the invention; FIG. 2 is a perspective view showing the fall board stopper and its related parts; and FIG. 3 is a cross sectional view showing a part of the fall board that is stopped at a rest position by the fall board stopper. In FIGS. 1 to 3, parts identical to those shown in FIGS. 7A and 7B are designated by the same reference numerals; hence, the detailed description thereof will be omitted.

Reference numeral 20 designates a fall board stopper adapted to a fall board 1. That is, the fall board stopper 20 is constituted by a pair of first stopper members 21 that are attached to interior surfaces of side boards 8, which form the exterior outline of a keyboard instrument 10, and a pair of second stopper members 22 that are attached to both ends of the backend portion of the fall board 1 in correspondence with the first stopper members 21.

Each of the first stopper members 21 is formed in a block shape and is composed of a prescribed metal, wherein it has a roughly U-shaped bearing hollow 17 for axially supporting a shaft 15, which can be freely rotated, on the upper surface thereof. That is, the first stopper member 21 shares the function of the metal member 16 of the open/close device 12 shown in FIG. 7B. In addition, an engagement hollow 23 is formed on the interior wall of the first stopper member 21, which is arranged opposite to the backend portion of the fall board 1, and is arranged backwardly from the bearing hollow 17. The engagement hollow 23 is horizontally elongated and is formed to have a rectangular shape in cross section. Furthermore, a slope 24 is formed above the engagement hollow 23 and is gradually reduced in thickness of the first stopper member 21 in an upward direction. The slope 24 is gradually projected towards the side of the fall board 1 along from upward to downward along a line that is vertical to a plane of a keyboard. In other words, a distance between the slope 24 and the side surface of the fall board 1 becomes narrower along the line that is vertical to the plane of the keyboard.

The second stopper members 22 are interlocked with the first stopper members 21 to stop the fall board 1 when the fall board 1 is opened. That is, a pair of the second stopper members 22 are respectively arranged inside of hollows (or holes) 25 that are formed on both sides of the backend portion of the fall board 1. It is preferable that each of the hollows 25 be separated from the shaft 15 as far as possible.

Details of the second stopper member 22 will be described with reference to FIGS. 2 and 3. The second stopper member 22 as a whole is formed by performing bend working on a plate spring, and it is therefore constituted by a fixed portion 22*a*, an elastically deformable portion 22*b*, and an engagement portion 22*c* having a circular arc shape (or a V-shape). Herein, the fixed portion 22*a* is fixed to the bottom of the hollow 25 by use of two wood screws 26, and the elastically deformable portion 22*b* is bent by a prescribed angle and is exposed from the hollow 25 to the surface together with the engagement portion 22*c*.

The bottom of the aforementioned hollow 25 is curved like a circular arc about the shaft 15 of the fall board 1; therefore, the second stopper member 22 is correspondingly bent to match the curved bottom shape of the hollow 25. The second stopper member 22 is arranged in such a way that when the fall board 1 is opened, it is located backwardly of the shaft 15, and when the fall board 1 is closed, it is located above the shaft 15. Reference numeral 26 designates a side block.

When the fall board 1 is opened by a player, the fall board 1 rotates about the shaft 15 in a clockwise direction in FIG. 1. The second stopper member 22 also rotates together with the fall board 1 in the clockwise direction. As the fall board 1 rotates further, the engagement portion 22*c* is brought into contact with the slope 24 of the first stopper member 21. The slope 24 is pressed against the engagement portion 22*c*, and the elastically deformable portion 22*b* is bent. Since the distance between the slope 24 and the side surface of the fall board 1 becomes narrower downwards along the line that is vertical to the plane of the keyboard, the elastically deformable portion 22*b* is further bent as the fall board 1 rotates to open. The elastically deformable portion 22*b* is guided to slide towards the engagement hollow 23 by the slope 24. When the engagement portion 22*c* reaches the engagement hollow 23, the elastically deformable portion 22*b*, which is bent, is released, and the engagement portion 22*c* is stably abutted to the engagement hollow 23.

On the other hand, if it is assumed that the player may intend to close the fall board 1, the player grips the leading end (which is the nearest portion towards the player when the fall board 1 is closed) of the fall board 1 and exerts the force on the fall board 1 to close. The rotational moment is created about the shaft 15 by the exerted force. Since the distance between the shaft 15 and the leading end of the fall board 1 is greater than the distance between the shaft 15 and the second stopper member 22, a greater rotational moment is exerted on the second stopper member 22. The rotational moment is approximately exerted on the second stopper member 22 about the shaft 15 in the counterclockwise direction in FIG. 1, and the exerted moment causes the elastically deformable portion 22*b* to be bent because the second stopper member 22 is abutted to the engagement hollow 23 in the open position of the fall board 1. The elastically deformable portion 22*b* needs to be sufficiently bent to cause the elestically deformable portion 22*b* to ride on the slope 24 to start the rotation of the fall board 1. The substantial force needs to be applied on the fall board 1 to initiate the rotation. In other words, the accidental force caused by small vibration does not cause the fall board 1 to start to close.

As described above, when the fall board 1 is closed, the second stopper member 22 is located above the shaft 15 and is not brought into contact with the first stopper member 21. Therefore, when the user starts opening the fall board 1, the second stopper member 22 would not serve as a load to the opening motion of the fall board 1. When the fall board 1 is gradually opened, the second stopper member 22 is rotated backwardly about the shaft 15 together with the fall board 1, so that the top portion of the engagement portion 22*c* descends down while sliding along the slope 24 of the first stopper member 21. For this reason, the elastically deformable portion 22*b* of the second stopper member 22 is gradually and elastically deformed in the thickness direction so as to increase the contact area with the slope 24. Then, when the fall board 1 is maximally rotated in a backward direction and comes in contact with the exterior surface of the upper beam 4, the second stopper member 22 stands roughly perpendicular to the keybed 2, so that the engagement portion 22*c* thereof is completely engaged with the engagement hollow 23 of the first stopper member 21, whereby the elastically deformable portion 22*b* is elastically restored from a deformed state thereof. Thus, it is possible to establish a mechanical engagement between the engagement hollow 23 of the first stopper member 21 and the engagement portion 22*c* of the second stopper member 22, so that the fall board 1 can be reliably stopped at a opened position thereof. When the engagement portion 22*c* of the second stopper member 22 is engaged with the engagement hollow 23 of the first stopper member 21 so that the elastically deformable portion 22*b* is elastically restored from the deformed state thereof, a load imparted to the fall board 1 is slightly reduced so that the user may sense a stopped condition on fingers holding the fall board 1 and hear a 'click' sound. This allows the user to detect mutual engagement established between the first stopper member 21 and the second stopper member 22. When the lower end of the engagement portion 22*c* of the second stopper member 22 is moved downwards or moved in a slanted direction so that it is pressed in contact with a lower end 23*a* of the engagement hollow 23 of the first stopper member 21 to cause a downward force, it is possible to cause rotational moment for the fall board 1 that is rotated in an opening direction about the shaft 15. Therefore, it is possible to further improve the stability of the fall board 1 in opening operation.

As described above, the present embodiment is designed to establish a mechanical engagement between the first stopper member 21 and the second stopper member 22 when the fall board 1 is stopped in an opened state. Therefore, it is possible to realize the fall board stopper having a simple constitution, by which the fall board 1 can be reliably stopped in an opened state thereof and can be prevented from being normally (or unexpectedly) closed due to vibration and the like.

Figure 4:
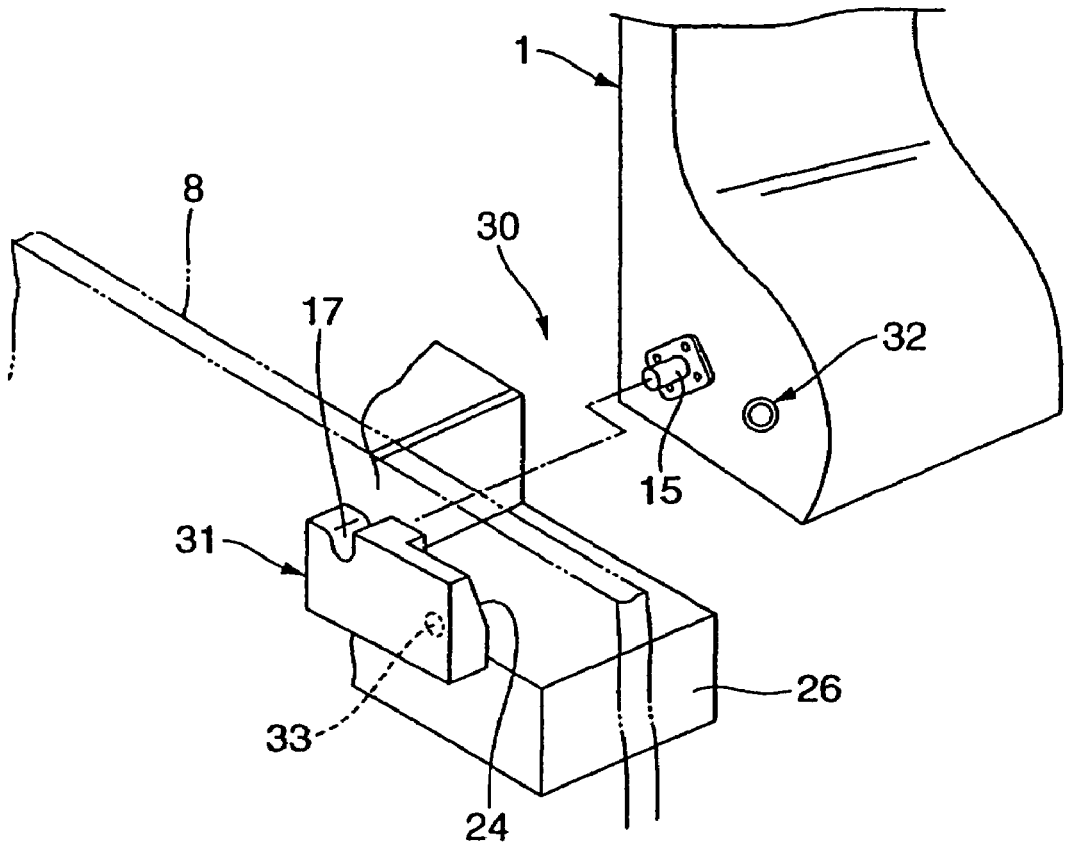
FIG. 4 is a perspective view showing essential parts of a fall board stopper and its related parts in the grand piano in accordance with another embodiment of the invention.
Figure 5:
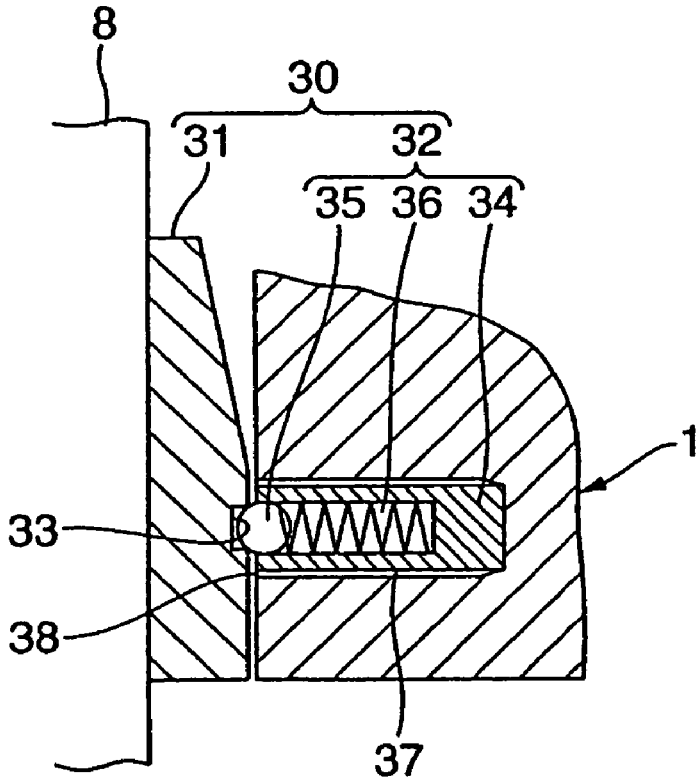
FIG. 5 is a cross sectional view showing a part of the fall board that is opened and then stopped at a rest position by the fall board stopper shown in FIG. 4.

Next, another embodiment of the invention will be described with reference to FIGS. 4 and 5, wherein FIG. 4 is a perspective view showing a fall board stopper adapted to a grand piano having a fall board, and FIG. 5 is a cross sectional view showing a part of the fall board that is opened and then stopped at a rest position by the fall board stopper.

That is, the fall board 1 of the grand piano is equipped with a fall board stopper 30 constituted by a first stopper member 31 and a second stopper member 32, which are combined together to stop the fall board 1 when opened. Specifically, the first stopper member 31 is attached to the interior surface of the side board 8, and the second stopper member 32 is embedded at a prescribed position of the backend portion of the fall board 1.

The first stopper member 31 shown in FIG. 4 is basically similar to the first stopper member 21 shown in FIG. 2. Unlike the foregoing first stopper member 21 having the engagement portion 23 corresponding to the elongated hollow, the first stopper member 31 has an engagement portion 33 corresponding to a circular recess.

Figure 6:
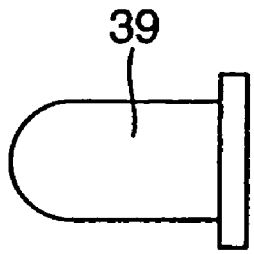
FIG. 6 is a plan view showing an example of an engagement member adapted to the fall board stopper.

As the second stopper member 32, it is possible to use a ball plunger that may be commercially available. As shown in FIG. 5, the ball plunger 32 is constituted by a cylindrical case 34 whose one end is opened, a ball 35 that is kept in the inside space of the cylindrical case 34, and a compression coil spring 36 associated with the ball 35 in the cylindrical case 34. External threads 37 are formed on the exterior circumferential surface of the cylindrical case 34, which is thus screwed into an internally-threaded hole 38, which is formed at a prescribed position of the backend portion of the fall board 1, in such a way that the opening of the cylindrical case 34 substantially matches the surface of the side portion of the fall board 1. The opening of the cylindrical case 34 is subjected to drawing in such a way that the diameter thereof becomes slightly smaller than the diameter of the ball 35, which is thus prevented from being dropped or falling off from the cylindrical case 34. The ball 35 is pressed by the compression coil spring 36 and is forced to move towards the opening of the cylindrical case 34; hence, it may be partially exposed to the outside of the opening of the cylindrical case 34. The present embodiment uses the ball plunger 32 whose 'movable' engagement member corresponds to the ball 35, which is not necessarily restricted. That is, it is possible to use a pin 39 having a round projection shown in FIG. 6.

In the present embodiment, the fall board 1 is stopped upon a mechanical engagement established between the engagement portion 33 and the ball 35 of the ball plunger 32

(or the round projection of the pin 39). Hence, it is possible to improve the stability of the fall board 1 when opened.

In the aforementioned embodiments, each of the first stopper members 21 and 31 is attached to the side board 8, and each of the second stopper members 22 and 32 is attached to the backend portion of the fall board 1. In summary, this invention is basically designed to stop the fall board 1 upon the mechanical engagement established between the first stopper member and the second stopper member when the fall board 1 is maximally opened and is placed roughly perpendicular to the keybed 2. Therefore, it is possible to attach the first stopper member to the backend portion of the fall board 1 while attaching the second stopper member to a prescribed portion of the keyboard instrument 10.

As the second stopper member, it is possible to use a plunger (or a solenoid) requiring electric power, preferably, a latch-type plunger. Thus, the fall board stopper of this invention can be preferably used for a player piano (or a piano having an automatic performance function) and a silent-type (or sound-mute-type) piano, for example.

As described heretofore, this invention has a variety of effects and technical advantages, which will be described below.

(1) A fall board stopper adapted to a keyboard instrument is designed to stop a fall board when opened upon a mechanical engagement established between a first stopper member and a second stopper member. Therefore, it is possible to improve the stability of the fall board when opened because the fall board can be reliably prevented from being naturally (or unexpectedly) closed due to vibration and the like. In particular, the fall board stopper of this invention is preferably adapted to a grand piano in which an opening angle of a fall board is approximately set to 90° and in which the fall board is held substantially perpendicular to a keybed when opened.

(2) In addition, the fall board stopper does not influence the operation of the fall board when closed. That is, the user (or player) can open the fall board, equipped with the fall board stopper, with a force similar to that normally applied to a fall board not equipped with the fall board stopper. Furthermore, both the first and second stopper members have simple structures, which can be manufactured with ease and with a relatively low cost.

(3) Specifically, the first stopper member has an engagement portion corresponding to a hollow, and the second stopper member has a plate spring, so that when the fall board is opened, the plate spring is mechanically engaged with the engagement portion.

(4) Alternatively, the first stopper member has an engagement portion corresponding to a recess, and the second stopper member has a ball plunger, so that when the fall board is opened, a ball of the ball plunger is mechanically engaged with the engagement portion.

(5) Moreover, the first stopper member has an engagement portion corresponding to a recess, and the second stopper member has a plunger or a solenoid, so that the fall board stopper can be adapted to an electric piano such as a player piano and a silent-type piano requiring electricity.

As this invention may be embodied in several forms without departing from the spirit or essential characteristics thereof, the present embodiments are therefore illustrative and not restrictive, since the scope of the invention is defined by the appended claims rather than by the description preceding them, and all changes that fall within metes and bounds of the claims, or equivalents of such metes and bounds are therefore intended to be embraced by the claims.

What is claimed is:

1. A fall board stopper for stopping a fall board of a keyboard instrument whose backend portion is pivotally supported in a free rotation manner when the fall board is opened or closed, said fall board stopper comprising:

a first stopper member attached to either a prescribed part of the keyboard instrument or the fall board at a prescribed position; and a second stopper member attached to the other of the keyboard instrument and the fall board, wherein the second stopper member engages with an engagement portion of the first stopper member when the fall board is opened.

2. A fall board stopper for stopping a fall board of a keyboard instrument whose backend portion is pivotally supported in a free rotation manner when the fall board is opened or closed, said fall board stopper comprising:

a first stopper member attached to either a prescribed part of the keyboard instrument or the fall board at a prescribed position; and a second stopper member attached to the other of the keyboard instrument and the fall board, wherein the second stopper member engages with an engagement portion of the first stopper member when the fall board is opened, and wherein the engagement portion of the first stopper member is a hollow, which is engaged with the second stopper member corresponding to a plate spring.

3. The fall board stopper according to claim 1, wherein the engagement portion of the first stopper member is a recess, which is engaged with the second stopper member corresponding to a ball plunger.

4. The fall board stopper according to claim 1, wherein the engagement portion of the first stopper member is a hollow, which is engaged with the second stopper member corresponding to a solenoid.

5. A fall board stopper for stopping a fall board of a keyboard instrument whose backend portion is pivotally supported in a free rotation manner when the fall board is opened or closed, said fall board stopper comprising:

a first stopper member attached to either a prescribed part of the keyboard instrument or the fall board at a prescribed position; and a second stopper member attached to the other of the keyboard instrument and the fall board, wherein the second stopper member engages with an engagement portion of the first stopper member when the fall board is opened, wherein the engagement portion of the first stopper member is a hollow, which is engaged with the second stopper member corresponding to a plate spring, and wherein when the fall board is opened, a tip end portion of the plate spring slides along a slope of the first stopper member and is engaged with the hollow.

6. The fall board stopper according to claim 3, wherein when the fall board is opened, a ball partially projected outside from the ball plunger is engaged with the recess of the first stopper member.

* * * * *